US006119928A

United States Patent [19]

Lasson et al.

[11] Patent Number: 6,119,928

[45] **Date of Patent: *Sep. 19, 2000**

[54] LAMINATED PACKAGING MATERIAL HAVING FLUTED MEDIUM

[75] Inventors: Rolf Lasson, Lund; Theo Louman, Höör; Rickard Norenstam, Kävlinge, all of Sweden; Hichem Bouraoui, Palatine, Ill.; Patrick Duvander, Lund, Sweden

[73] Assignee: Tetra Laval Holdings & Finance, SA, Pully, Switzerland

[ * ] Notice: This patent is subject to a terminal disclaimer.

[21] Appl. No.: 09/018,778

[22] Filed: Feb. 4, 1998

[51] Int. Cl.[7] ..... B65D 3/00

[52] U.S. Cl. ..... 229/5.82; 229/939; 229/5.84; 229/128.42; 428/163; 428/167

[58] Field of Search ..... 229/5.81, 5.84, 229/939, 3.5 R; 220/62.19, 62.2; 428/163, 167, 246, 34.1, 34.2

[56] References Cited

U.S. PATENT DOCUMENTS

| | | | |
|---|---|---|---|
| 3,042,278 | 7/1962 | McCullough | 229/939 X |
| 3,406,052 | 10/1968 | Peters | 229/939 X |
| 3,523,058 | 8/1970 | Shick | 229/939 X |
| 3,635,451 | 1/1972 | Wagner | 229/939 X |
| 3,796,307 | 3/1974 | McKinney | 229/393 X |
| 4,872,590 | 10/1989 | Sasaki et al. | 229/5.81 |
| 4,940,612 | 7/1990 | Gibbons et al. | 229/939 X |
| 5,575,418 | 11/1996 | Wu et al. | 229/939 X |
| 5,628,451 | 5/1997 | Neary . | |
| 5,674,593 | 10/1997 | Earl | 229/939 X |
| 5,848,748 | 12/1998 | Bouraoui et al. | 229/152.42 |

*Primary Examiner*—Stephen P. Garbe
*Assistant Examiner*—Tri M. Mai
*Attorney, Agent, or Firm*—Welsh & Katz

[57] ABSTRACT

A laminated packaging material for fabrication into a container for a flowable food product is disclosed herein. The laminated packaging material has a fluted medium between a first layer and second layer. The fluted medium may have a flute density of 200 to 450 flutes per linear foot. The fluted medium may also have a flute height profile of 8 mils to 50 mils. The laminated packaging material may be fabricated into a gabletop carton or a parallelepiped container such as the TETRA BRIK® container. The laminated packaging material may have a barrier layer such as aluminum or another gas impermeable composition. The laminated packaging material provides substantial material savings due to the fluted medium.

2 Claims, 3 Drawing Sheets

LAMINATED PACKAGING MATERIAL HAVING FLUTED MEDIUM

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to packaging material for flowable food containers. Specifically, the present invention relates to a laminate composed of at least one layer of a corrugated packaging material for a container for flowable materials.

2. Description of the Related Art

Containers for flowable food products are available in various forms. One form is the commonly recognizable gabletop carton such as the TETRA REX® carton available from Tetra Pak, Inc. of Chicago, Ill. Another type of container is the ubiquitous TETRA BRIK® parallelepiped container also available from Tetra Pak, Inc. of Chicago, Ill. The gabletop carton includes four side panels which are finished, at the top, with a peaked, gable-like configuration while the parallelepiped container is formed from a web of material and has four sides and a substantially flat top and bottom. Such containers are used for packaging and storing liquid foods such as milk, juice and the like, as well as other, consumer liquid products such as laundry detergent. Such containers are also used for storing dried, powdered and granulated good, such as dried soups. Such containers are also known for use in storing medicinal goods such as powdered or granulated Epsom salts.

Traditionally, such gabletop cartons are formed from "blanks" which are formed or erected and transported into a filling apparatus in which the carton is filled and the top or gable portion folded and sealed. The blanks are shipped and stored unformed or flat. The cartons are generally erected within the filling machine. As mentioned above, parallelepiped containers are fabricated on a vertical form, fill and seal packaging machine from a web of material.

In a common arrangement for liquid packaging and storage, the packaging material is formed from a laminated structure. One known laminate includes a fiberboard substrate having a layer or a coating of a polymeric material, such as low density polyethylene (LDPE) on both sides of the substrate. The "sides" of the substrate are the inside and outside surfaces of the container is completely formed.

The polymeric layers provide a measure of liquid impermeability to the material, thus providing a substantially "leak resistant" container, with the inner polymeric layer preventing leakage from the container outward, and the outer polymeric layer retarding moisture or humidity transfer from the environs inward. The laminated structure also reduces wicking of the material, which is absorption of liquid by the container material, and subsequent mass transfer, of the liquid from the site of absorption.

The laminate may also include a barrier layer adjacent to the substrate, between the substrate and the inner polymeric layer. The barrier layer enhances gas impermeability of the carton which facilitates retaining the container contents fresh. The barrier layer can be positioned directly on the substrate. Alternately, and preferably, the laminate can include a polymeric layer between the barrier layer and the substrate as well as a polymeric layer over the barrier. In this configuration, the polymeric layer that is disposed between the barrier and the substrate can serve to adhere the barrier and substrate to one another. Such barrier layers are used, typically, in cartons for storing fruit juice and the like.

A major cost in the manufacture of such containers is the cost of the paper materials, which correlates to paper grammage for each container. Paper products are often measured in "grammage", which is the weight of the board in grams per square meter, (gms/m$^2$). As such, increased "grammage" of materials generally correlates to increased cost. Any reduction in paper grammage generally brings about a savings in the cost of the container. However, relatively lighter weight materials, i.e., lower grammage materials, generally have less strength than materials having a higher grammage. As such, a balance must be made between cost reduction and strength.

Accordingly, there continues to be a need for a lighter weight material for the manufacture of paperboard and paperboard-like Paper products are often measured in "grammage", which is the weight of the board in grams per square meter (gms/m$^2$). As such, increased "grammage" of materials generally correlates to increased cost. Such a material and carton configuration provides strength and durability in a reduced cost package for packaging and storing solid, viscous and liquid goods.

BRIEF SUMMARY OF THE INVENTION

One aspect of the present invention is a laminated packaging material for a flowable food container. The laminated packaging material has a first layer, a second layer and a fluted medium therebetween. The first and second layers are composed of a fiberboard material. The fluted medium is juxtaposed between the inner surfaces of the first and second layers. The fluted medium has a flute density of 200 to 450 flutes per linear foot.

Another aspect of the present invention is a laminated packaging material for a flowable food container having a first and second layers with a third sinusoidal layer therebetween. The first and second layers are composed of a fiberboard material with a polymeric material coating thereon. The third layer is juxtaposed between the inner surfaces of the first and second layers. The sinusoidal cross-section of the third layer forms a plurality of compartments extending the length of the laminated packaging material. Each of the plurality of compartments is defined by a the third layer and one of the first and second layers.

It is a primary object of the present invention to provide a laminated packaging material having a fluted medium juxtaposed between two fiberboard layers.

It is an additional object of the present invention to provide a laminated packaging material which provides substantial material savings.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1A a perspective view of a corrugated gabletop carton embodying the principles of the present invention, the carton being shown with an integral flap-type pour spout, and being shown for illustrative purposes with flute column lines thereon;

Figure 1A:
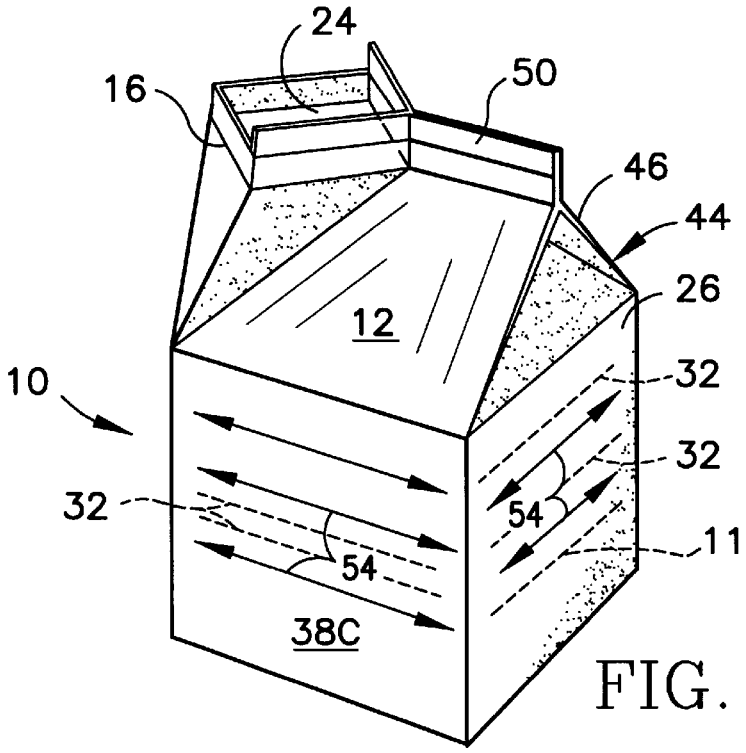
Figure 2A:
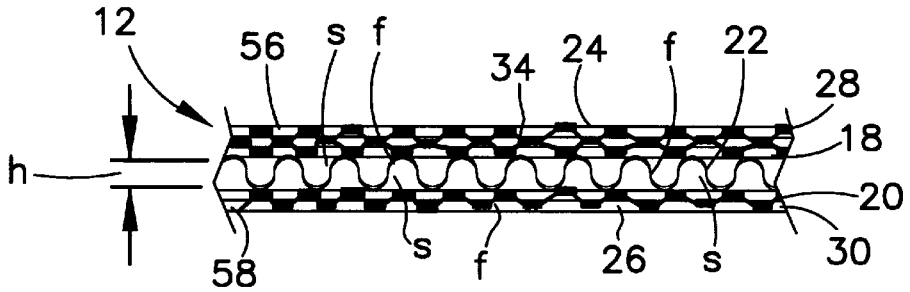
Figure 2B:
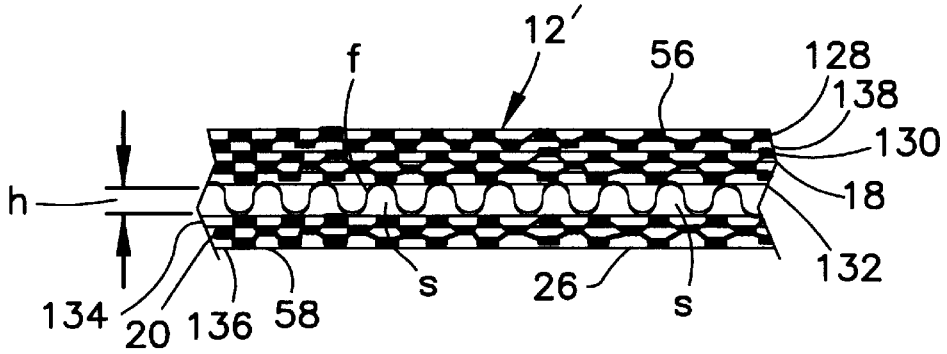
Figure 1B:
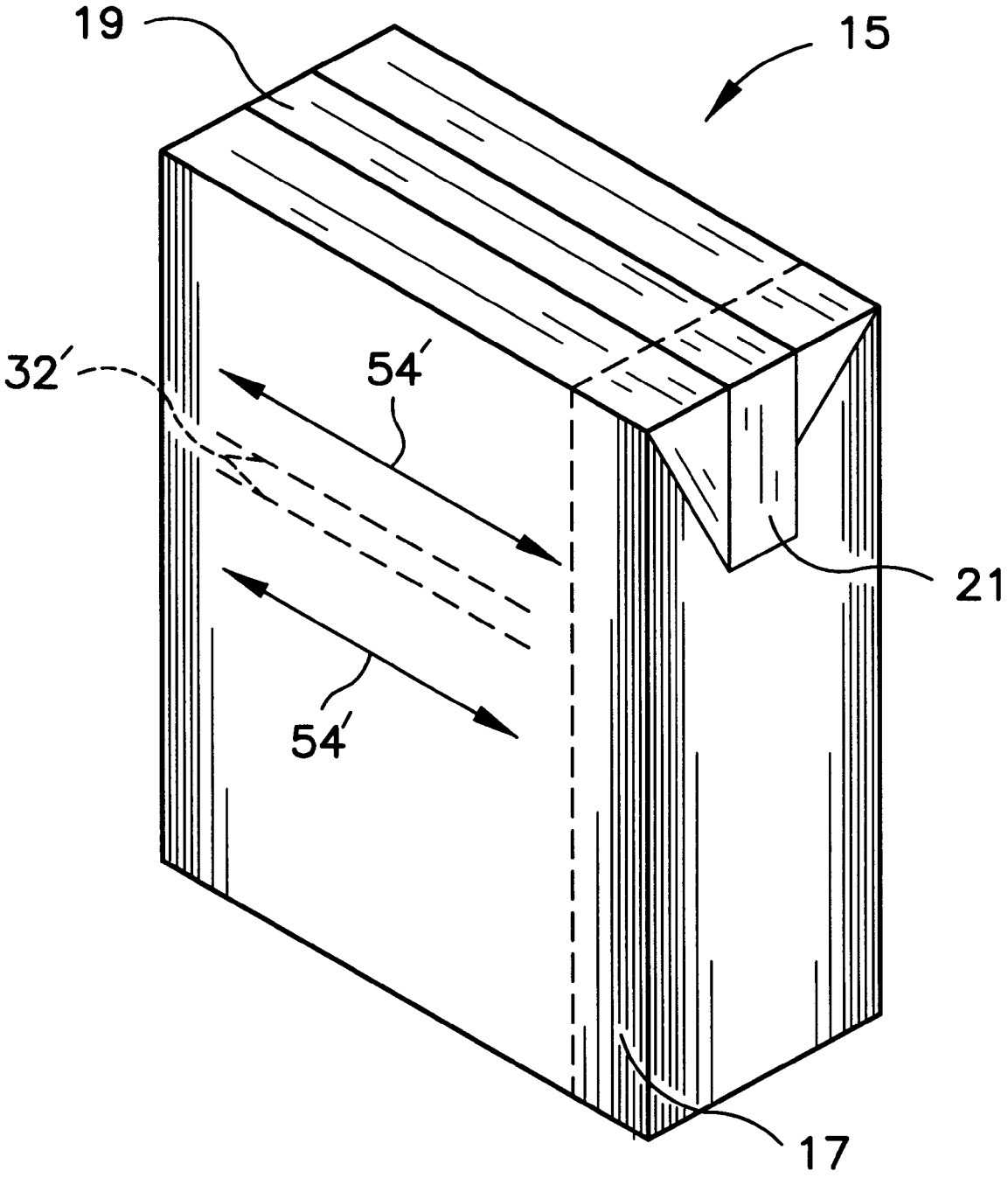
Figure 3A:
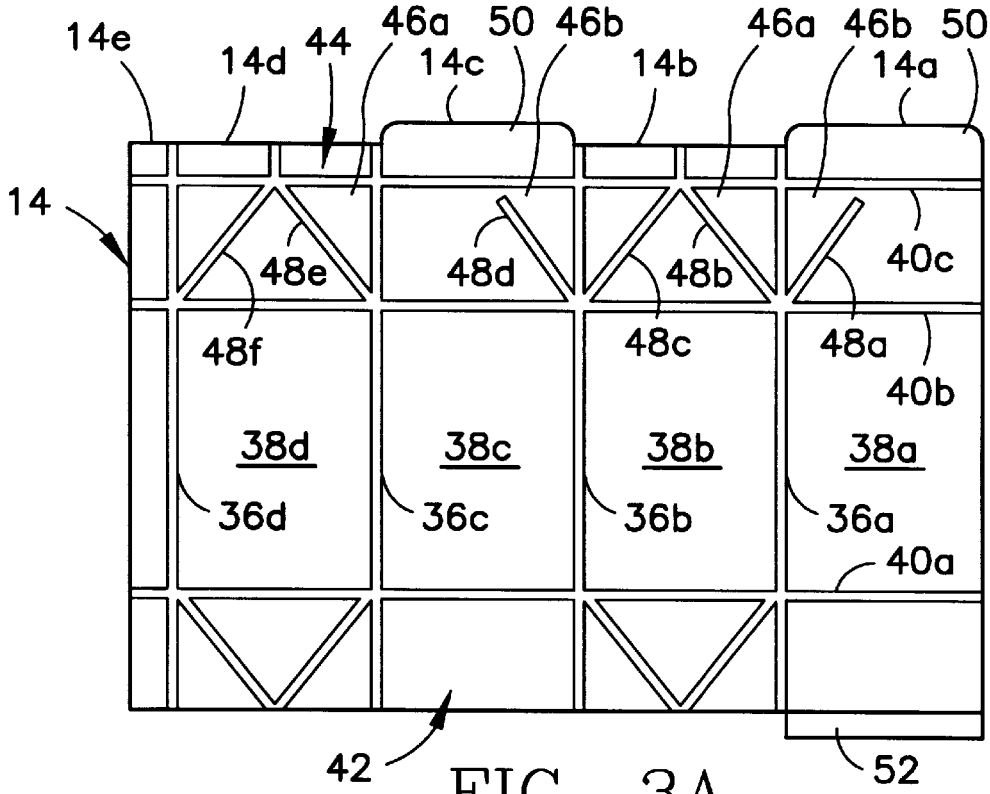
Figure 3B:
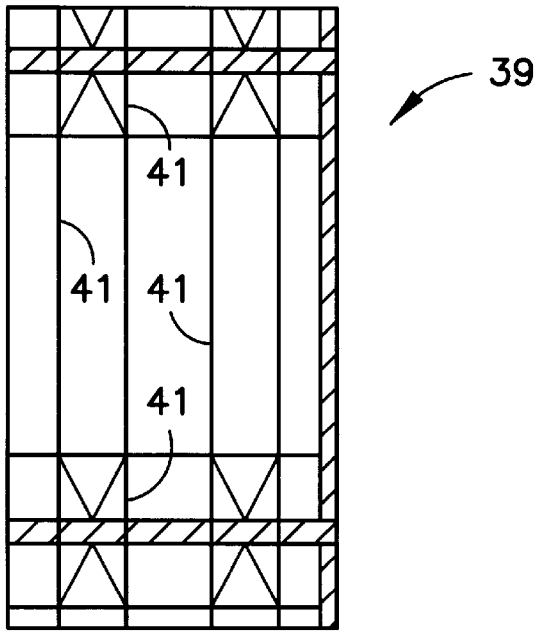

There is illustrated in FIG. 1B a perspective view of a corrugated parallelepiped container embodying the principles of the present invention, the container being shown for illustrative purposes with flute column lines thereon;

FIG. 2A is a cross-sectional view of the preferred embodiment of the corrugated packaging material of the present invention;

FIG. 2B is a cross-sectional view of an alternative embodiment of the corrugated packaging material of the present invention;

FIG. 3A is a view of an unassembled or unerected carton, commonly referred to as a carton blank; and FIG. 3B is a view of a section of a web of material from which the container 15 of FIG. 1B is fabricated on a form, fill and seal packaging machine.

DETAILED DESCRIPTION OF THE INVENTION

Referring now to the figures and in particular to FIG. 1A, there is shown a gabletop carton 10 formed of a corrugated material 12, 12'. The carton 10 defines a product storage region 11 and is adapted to directly store liquid products, such as milk and juice, viscous products, such as mayonnaise, and solid, e.g., granulated or powdered products. The carton 10 is configured to store these products without an intervening liner, such as a flexible polymeric bag disposed between the product and the carton. The carton 10 is formed from a material 12, 12' that is first prepared into a form commonly referred to as a carton "blank", illustrated at 14 in FIG. 3, to facilitate erecting the carton 10. The carton 10 shown in FIG. 1 includes a pour spout 16 formed from a portion of the carton material 12, 12'. The pour spout 16 folds back, inward of the carton 10 to form a reclosure for the carton 10.

The carton blank 14 is formed from a paperboard material 12, 12'. In known cartons formed of a typical solid wall construction, the material weight or grammage will vary depending upon the size and strength requirements of the carton, the weight and state (e.g., liquid or solid) of the contained product and the intended end use of the carton. In a known one-liter carton, the paperboard grammage is about 280 to about 300 gms/$m^2$.

In FIG. 1B, a parallelepiped container 15 is shown. As mentioned previously, the container 15 is formed on a vertical form, fill and seal machine from a web of material. The web is sealed longitudinally to form a longitudinal seal 17, then sealed transversally to create a transverse seal 19. The container 15 is then folded and the top edges 21 are sealed to the sides of the container 15. A variation of this container 15 is the TETRA PRISMA™ package which is also available from Tetra Pak. Inc. of Chicago, Ill. A TETRA PRISMA™ package is disclosed in co-pending U.S. patent application Ser. No. 08/739,723 filed on Oct. 23, 1996.

Yet another type of container which may incorporate the novel packaging material is a TETRA TOP® container also available from Tetra Pak, Inc. of Chicago, Ill.

The carton 10 illustrated in FIG. 1A and the parallelepiped container 15 are both manufactured from the novel corrugated packaging material 12, 12' of the present invention, with cross-sections of exemplary materials 12, 12' shown in FIGS. 2A and 2B. Referring to FIG. 2A, the material 12 includes an inner facing sheet 18, an outer facing sheet 20 and a fluted medium 22 positioned between the inner and outer facing sheets 18, 20. The fluted medium 22 contacts and is fixed between the inner and outer facing sheets 18, 20. For purposes of the present discussion, the inner facing sheet 18 is the portion of the material 12, 12' that is inward of the carton 10 or the container 15, e.g., the inner surface 24 of the carton 10 that is in contact with the contained material, and the outer facing sheet 20 is that portion of the material 12, 12' that is outward of the carton 10, e.g., the outer surface 26 of the carton 10, that is handled by a user.

The inner and outer facing sheets 18, 20 can be formed from common paperboard material that have applied thereto a liquid resistant material such as the polymeric LDPE layers 28, 30 shown in FIG. 2A. The fluted medium 22 is typically formed from paperboard material that may have a liquid resistant material applied to one or both sides thereof, or may be used untreated.

Alternately, as shown in FIG. 2B, the inner and outer facing sheets 18, 20 can have polymeric layers 130, 132, 134, 136 disposed on each side of each facing sheet 18, 20 to serve as an adhesive to adhere the materials to one another. The polymeric layers 130, 132 and 134, 136 further reduce moisture transfer. As previously discussed, I a construction that includes a gas impermeable barrier 138 such as foil, the foil 138 can be positioned on the polymeric layer 130, and an additional polymeric layer 128 can be provided over the foil 138.

When observed vertically, the flutes f define columns 32 that traverse the material 12, 12' in a direction perpendicular to the wave-like form shown in FIG. 2. That is, the columns 32 are oriented into and out of the figure sheet of FIG. 2. This orientation also increases the grip stiffness. While the present discussion is directed to, and makes reference to the material 12 illustrated in FIG. 2A, it is to be understood that the present discussion applied equally well to the material 12' illustrated in FIG. 2B, as well as other corrugated material configurations.

When observed as a cross-section of the material traversing a plurality of columns 32, as seen in FIGS. 2A and 2B, the flutes f have an arch-like appearance. The arch is a basic structural shape that is capable of supporting substantial weight loads and is recognized as a structurally acceptable manner in which to span a given space. Those skilled in the art will also recognize that corrugated cartons can be formed having a plurality of walls, i.e., two or more corrugated media (not shown) having a facing sheet or liner board interposed between the corrugated media and facing sheets on the inner and outer surfaces thereof. It will be apparent from the drawings that the spaces s between the flutes f and between the flutes f and the facing sheets 18, 20 are open to the environs. It will also be recognized by those skilled in the art that the edges (from which the flutes f can be seen) can be sealed to seal the spaces s and prevent moisture ingress and wicking.

Referring to FIG. 2A, the material 12 can include one or more polymeric layers 28, 30, such as the aforementioned LDPE, to provide further liquid resistance, and a barrier layer 34 to provide gas impermeability. In a preferred arrangement, the barrier 34 is a metal foil, such as aluminum foil. The barrier layer 34 reduces the passage of gas, such as oxygen, through the carton 10, and thus enhances the ability of the carton 10 to maintain the contents fresh. Typically, as provided previously, and as illustrated in FIG. 2B, the barrier layer 138 is disposed on the facing sheet 18 with a polymeric layer 130 between the facing sheet 18 and the barrier 138. An additional polymeric layer 128 is provided over the barrier 138 as an innermost laminate material.

Referring now to FIG. 3A, there is shown a carton blank 14, in unerected form. The blank 14 includes five vertical panels 14*a–e* defined by four vertical score lines or creases 36*a–d*. Four of the vertical panels 14*a–d* define the side walls 38*a–d* of the carton 10. The fifth vertical panel 14*e* provides a tab for sealing the carton blank walls 38*a* and 38*d* adjacent to one another when the carton 10 is erected or formed The blank 14 further includes three horizontal score lines or creases 40*a–c*. The lower horizontal line 40*a*, along with the portions of the vertical side wall creases 36*a–d* below the lower horizontal line 40*a*, define the bottom wall portion 42 of the carton 10. The two upper horizontal lines 40*b–c*, along with the portions of the vertical side wall creases 36*a–d* above the horizontal line 40*b*, define the top portion 44 of the carton 10 including the gable 46. The top portion 44 of the blank 14 also includes a plurality of angled gable creases or score hues 48*a–f* that define the gable 46 and pour spout 16. The gable includes inner and outer gable walls, 46*a* and 46*b*, respectively. Upper and lower fins 50, 52 facilitate sealing the carton blank walls 14*a–d* to one another when the carton 10 is erected.

A section of the web 39 of packaging material from which the container 15 is formed is shown in FIG. 3B. The section of the web 39 has a plurality of crease lines 41 which are manipulated to create the container 15 on a vertical form, fill and seal packaging machine.

A preferred embodiment of the carton 10 and the container 15 includes the carton material 12, 12' oriented such that the columns 32 traverse across the side walls 38*a–d*. That is, referring to FIGS. 1A and 1B, the columns 32 traverse in the direction shown by the lines indicated at 54. In this configuration, the columns 32 will intersect and will be redirected by the vertical side wall creases 36. As discussed previously, this orientation of the material 12, 12' increases the grip stiffness.

Standards were, at one time, promulgated for fluted material in which material was identified by an alpha character followed by the word "flute". For example, "A-flute" represented a material having 33± flutes per linear foot and an approximate height of 3/16 inch exclusive of the facing thickness. "E-flute" represented a material having 90±4 flutes per linear foot and an approximate height of 3/64 inch exclusive of the facing thickness. Although various flute f sizes can be used for the present invention, it is contemplated that a preferred material 12, 12' has a density of about 200 to about 450 flutes f per linear foot and most preferably a flute density of about 250 flutes per linear foot. Preferably, the material 12, 12' has an approximate flute f height or profile h of about 8 mils to about 50 mils, and most preferably about 8 mils to about 40 mils, exclusive of the facing sheet 18, 20 thickness.

It will be understood that the flute f density and height profile can vary depending upon the pressure applied to the material 12, 12' during the converting process, as the material is introduced to pressure or nip rollers that facilitate application of the facing sheets to the fluted medium.

Advantageously, the use of a material 12, 12' having a relatively high flute density, (i.e., closely or tightly positioned flutes) provides substantially flat inner and outer facing sheet outer surfaces 56, 58. That is, the outwardly facing surfaces 56, 58 of the inner and outer facing sheets 18, 20 define substantially flat planes that are readily printable with, for example, indicia such as graphics including logos and designs, information regarding the contents of the carton 10 or the container 15, and the manufacturer or packager The tightly positioned flutes f also provide a carton 10 or container 15 that has a smooth appearance rather than the ridged or rippled appearance generally associated with corrugated materials.

The novel use of a corrugated material 12, 12' for in a carton 10 or container 15, for example, for storing viscous materials and liquids such as juices, provides a number of advantages over the use of solid single or multi-layered paperboard materials. First, the weight of the can be reduced by using a corrugated material 12, 12'. Commensurate with a reduction in weight, generally, is a reduction in cost. Moreover, there is no loss in structural strength of integrity of the carton 10 or container 15 formed from corrugated material 12, 12'. Rather, it is contemplated that corrugated cartons 10 or containers 15 of the present invention can be configured to reduce weight over like solid wall cartons, while increasing the strength. Thus, when considering the carton 10 or container 15 on the basis of strength per unit weight (e.g., strength per grammage), the present corrugated cartons 10 or containers 15 provide a significant advantage over the known solid single or multi-layered paperboard cartons.

The reduction in raw material requirements, e.g., material weight, associated with the manufacture of the carton 10 or container 15 is commonly referred to as source reduction. Source reduction is the prevention of waste at its source by using the minimum quantity of materials necessary to achieve a given function. Use of corrugated materials in the manufacture of gabletop cartons, in accordance with the principles of the present invention furthers source reduction objectives. Thus, source reduction has environmental benefits as well as optimizing resources and minimizing costs.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

What is claimed is:

1. A laminated moisture resistant packaging material for packaging a liquid food product, the laminated moisture resistant packaging material comprising:

a first paperboard layer having an inner surface and an outer surface;

a second paperboard layer having an inner surface and an outer surface;

a fluted paperboard layer disposed between the inner surface of the first paperboard layer and the outer surface of the second paperboard layer, the fluted paperboard composed of a plurality of flutes, each of the flutes fixedly positioned between the inner surface of the first paperboard layer and the outer surface of the second paperboard layer, the flutes having a density of between 200 to 400 flutes per linear foot and a height profile of 8 mils to 40 mils;

an exterior polyethylene layer coated on the outer surface of the first paperboard layer;

a gas impermeable barrier layer disposed adjacent the inner surface of the second paperboard layer, the gas impermeable barrier layer defining first and second surfaces, the first surface lying adjacent the inner surface of the second paperboard layer; and an interior polyethylene layer coated on the second surface of the gas impermeable barrier layer.

2. A laminated moisture resistant packaging material for packaging a liquid food product, the laminated moisture resistant packaging material comprising:

a first paperboard layer having an inner surface and an outer surface;

a first polyethylene layer coated on the outer surface of the first paperboard layer;

a second polyethylene layer coated on the inner surface of the first paperboard layer;

a second paperboard layer having an inner surface and an outer surface;

a third polyethylene layer coated on the outer surface of the second paperboard layer;

a fourth polyethylene layer coated on the inner surface of the second paperboard layer;

a fluted paperboard layer disposed between the second polyethylene layer and the third polyethylene layer, the fluted paperboard composed of a plurality of flutes, each of the flutes fixedly positioned between the inner surface of the first paperboard layer and the outer surface of the second paperboard layer, the flutes having a density of between 200 to 400 flutes per linear foot and a height profile of 8 mils to 40 mils, a gas impermeable barrier layer disposed adjacent the fourth polyethylene layer, the gas impermeable barrier layer defining first and second surfaces, the first surface adjacent the fourth polyethylene layer; and a fifth polyethylene layer coated on the second surface of the gas impermeable barrier layer.

* * * * *